US012054349B2

(12) United States Patent
Nishikawa et al.

(10) Patent No.: US 12,054,349 B2
(45) Date of Patent: Aug. 6, 2024

(54) IMAGE RECORDING APPARATUS

(71) Applicant: BROTHER KOGYO KABUSHIKI KAISHA, Nagoya (JP)

(72) Inventors: Yasuo Nishikawa, Nagoya (JP); Hiroaki Takahashi, Nagoya (JP); Takuya Tsuji, Chiryu (JP); Kosuke Inuzuka, Nagoya (JP); Yoshimitsu Taniguchi, Tajimi (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 161 days.

(21) Appl. No.: 17/937,142

(22) Filed: Sep. 30, 2022

(65) Prior Publication Data

US 2023/0106292 A1 Apr. 6, 2023

(30) Foreign Application Priority Data

Oct. 1, 2021 (JP) ..... 2021-162998

(51) Int. Cl.
*B65H 35/06* (2006.01)
*B65H 5/36* (2006.01)
*B65H 35/00* (2006.01)

(52) U.S. Cl.
CPC ..... *B65H 35/06* (2013.01); *B65H 5/36* (2013.01); *B65H 35/0086* (2013.01); *B65H 2301/122* (2013.01)

(58) Field of Classification Search
CPC ..... B65H 35/06; B65H 35/0086; B65H 5/36; B65H 2301/12; B65H 2404/632; B65H 2404/693; B65H 2404/7412; B65H 2404/7414; B65H 29/60; B65H 85/00;
(Continued)

(56) References Cited

U.S. PATENT DOCUMENTS 7,725,071 B2 * 5/2010 Izuchi ..... B41J 13/009 399/397
8,152,391 B2 * 4/2012 Asada ..... G03G 15/234 400/188
11,491,808 B2 * 11/2022 Hayakawa ..... B41J 11/706
(Continued)

FOREIGN PATENT DOCUMENTS

JP H0922153 A 1/1997

*Primary Examiner* — Leslie A Nicholson, III
(74) *Attorney, Agent, or Firm* — Scully, Scott, Murphy & Presser, PC

(57) ABSTRACT

An image recording apparatus includes a recording unit, first and second rollers, a guide member, and a cutting unit. The recording unit performs image recording on a sheet conveyed in a conveying direction on a first conveyance path. The first roller is located further downstream than the recording unit in the first conveyance path. The second roller is located further downstream than the first roller in the first conveyance path. The guide member has a guide surface that forms a second conveyance path extending from a connection position of the first conveyance path between the first roller and the second roller. The cutting unit is located between the connection position and the second roller, cuts a sheet, and has a cutter. The guide member changes in posture between a first posture for forming the second conveyance path and a second posture for opening the second conveyance path.

6 Claims, 14 Drawing Sheets

(58) Field of Classification Search
CPC ..... B65H 2801/06; B41J 11/70; B41J 13/02; B41J 13/0045
USPC ..... 270/5.02, 21.1
See application file for complete search history.

(56) References Cited

U.S. PATENT DOCUMENTS 11,623,461 B2 * 4/2023 Takahashi ..... B26D 1/185 358/301
11,685,172 B2 * 6/2023 Yajima ..... B41J 11/007 347/104
11,780,253 B2 * 10/2023 Yajima ..... B41J 11/42 347/16
11,897,258 B2 * 2/2024 Takahashi ..... B41J 13/0036

* cited by examiner

IMAGE RECORDING APPARATUS

REFERENCE TO RELATED APPLICATIONS

This application claims priority from Japanese Patent Application No. 2021-162998 filed on Oct. 1, 2021. The entire content of the priority application is incorporated herein by reference.

BACKGROUND ART

An image recording apparatus having a cutting unit configured to cut a sheet is known. The image recording apparatus has the cutting unit configured to cut a copy sheet on which an image has been formed, and the copy sheet conveyed and printed in the image forming apparatus is cut and discharged. The image recording apparatus performs printing on one side of the copy sheet and cuts the copy sheet.

When performing printing on both sides of a recording sheet, a re-conveyance path is connected to a conveyance path, the recording sheet whose first side has been printed is returned from the re-conveyance path to the conveyance path to reverse the two sides of the recording sheet, and printing is performed on the second side. In the related art, there is no apparatus where a cutter configured to cut a recording sheet is arranged further downstream than a connection position with the re-conveyance path in a conveying direction.

DESCRIPTION

An object of the present disclosure is to provide an image recording apparatus having a cutting unit provided further downstream than a second conveyance path for double-sided printing, in which it is easily capable of resolving a jam occurred in the image recording apparatus.

(1) An image recording apparatus includes: a recording unit configured to perform image recording on a sheet that is conveyed in a conveying direction on a first conveyance path; a first roller located, in the first conveyance path, further downstream than the recording unit in the conveying direction; a second roller located, in the first conveyance path, further downstream than the first roller in the conveying direction; a first guide member having a first guide surface that forms a second conveyance path extending from a connection position of the first conveyance path between the first roller and the second roller; and a cutting unit located between the connection position of the first conveyance path and the second roller, and configured to cut a sheet, in which the cutting unit has a cutter, and the first guide member is configured to change in posture between a first posture for forming the second conveyance path and a second posture for opening the second conveyance path.

Since the second conveyance path is opened by putting the first guide member into the second posture, the user can put the user's hand into the image recording apparatus to resolve a jam occurred in the image recording apparatus.

(2) The image recording apparatus may further include a protection member configured to cover a lower side of the cutter.

Since the protection member is configured to cover the lower side of the cutter, when the user accesses an internal space of the image recording apparatus from below the cutter, it is difficult for the user to contact the cutter. In addition, grit and dust generated as a result of cutting the sheet is less likely to fall downward by the protection member.

(3) A first distance from a downstream end of the protection member with respect to the conveying direction to the second roller in the conveying direction may be shorter than a second distance from the cutter to the second roller in the conveying direction.

According to the above configuration, it is further difficult for the user to contact the cutter.

(4) The image recording apparatus may further include a second guide member having a second guide surface located between the first guide surface of the first guide member and the second roller to form the second conveyance path, in which the cutter extends in a direction intersecting the conveying direction and is located further downstream than the second guide member in the conveying direction, and the first guide member is configured to change in posture between the first posture and the second posture by rotation.

Since the second support member is located further upstream than the cutter in the conveying direction, it is difficult for the user to contact the cutter from the upstream side of the conveying direction.

(5) An upper end of the second guide member may be located above the cutter.

According to the above configuration, it is further difficult for the user to contact the cutter.

(6) The cutting unit may further have a carriage configured to move in an intersection direction intersecting the conveying direction and a moving blade mounted to the carriage. A guide rail, which is configured to guide the carriage, may be connected to a pair of side frames. The cutter may be connected to the pair of side frames. The second guide member may be connected to the pair of side frames.

According to the above configuration, it is possible to attach the movable blade, the cutter, and the second guide member with high precision of the positional relationship, and to securely cut the sheet.

According to the present disclosure, it is easy to resolve a jam occurred in the image recording apparatus capable of performing double-sided printing.

FIG. 1 is an outward perspective view of an image recording apparatus 10 according to the present disclosure.

FIG. 2 schematically shows a structure of the image recording apparatus 10.

FIG. 3 is a plan view showing a main configuration of the image recording apparatus 10.

FIG. 4 is a perspective view showing a state in which a guide rail 81 of the image recording apparatus 10 is fixed to side frames 121 and 122.

Figure 11:
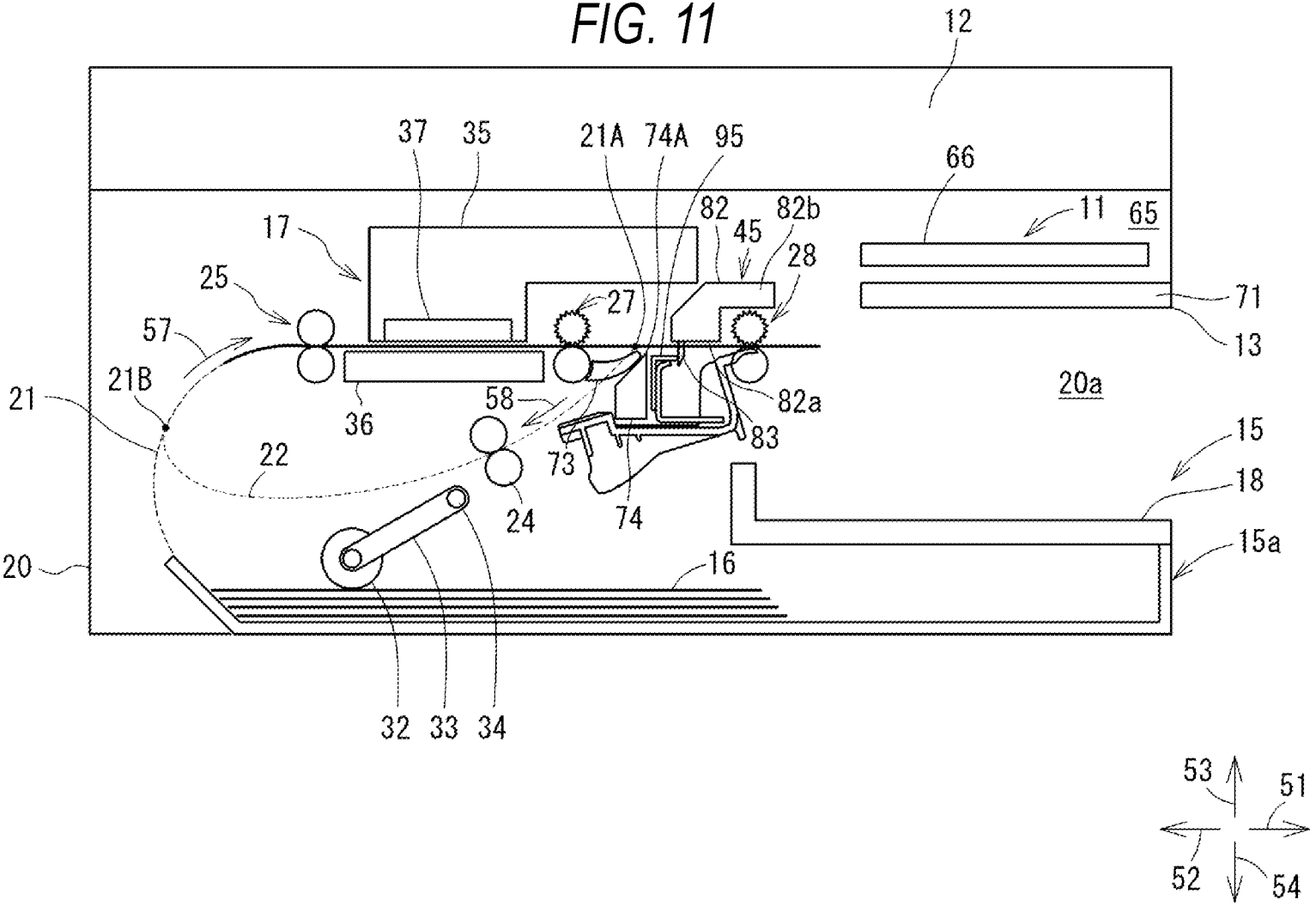

FIG. 11 schematically shows an image recording operation.

Figure 12:
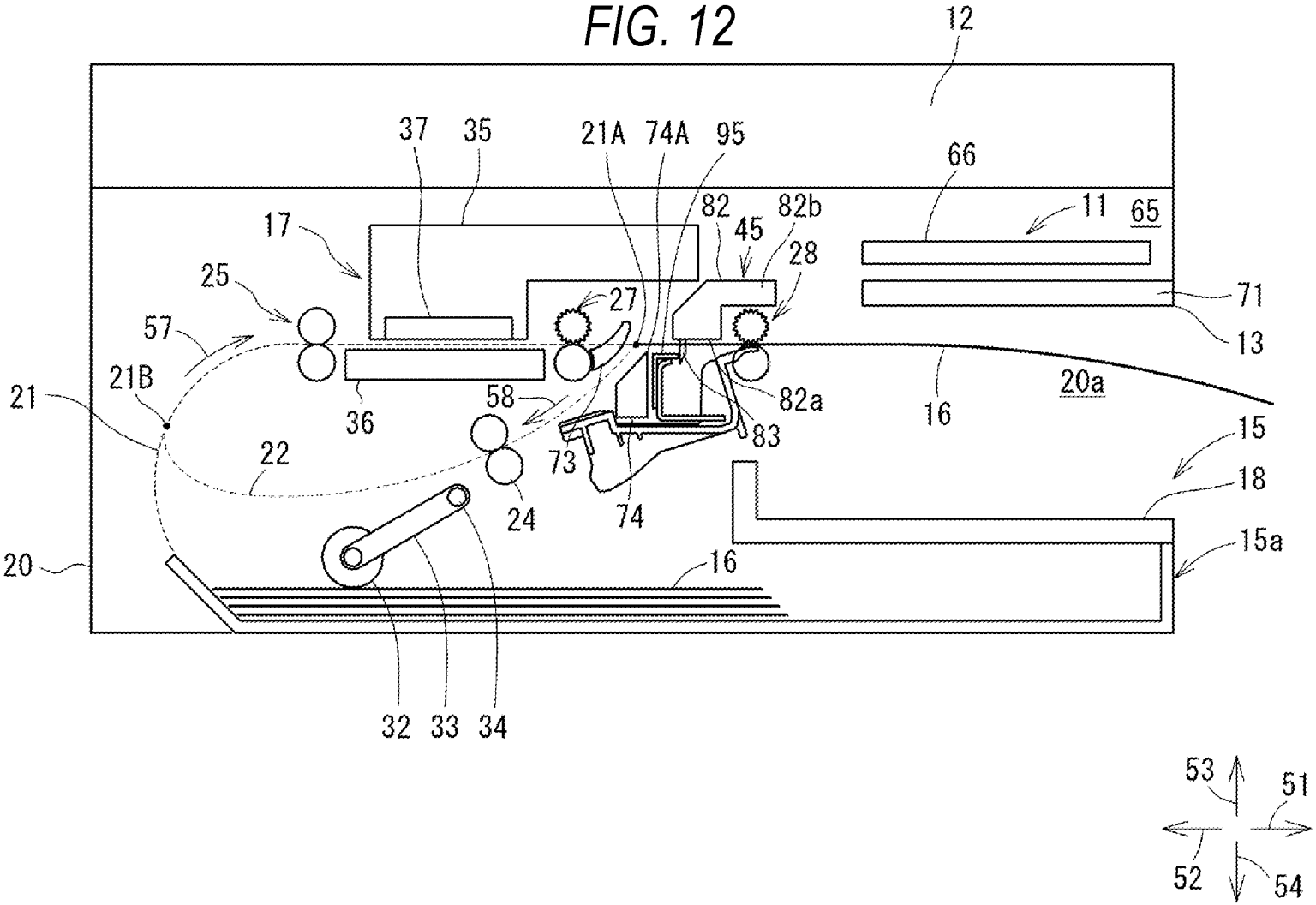

FIG. 12 schematically shows the image recording operation.

Figure 13:
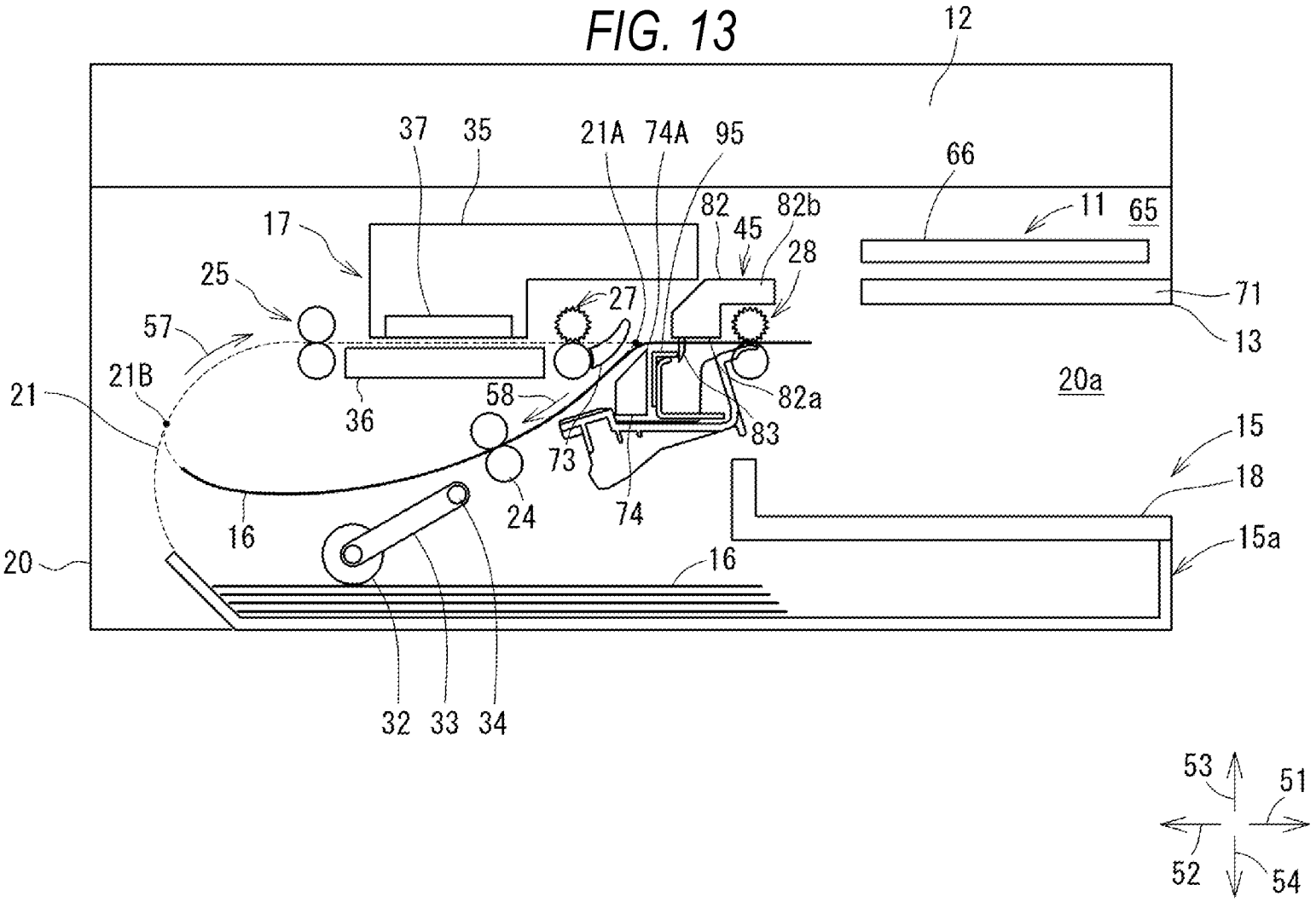

FIG. 13 schematically shows the image recording operation.

Figure 14:
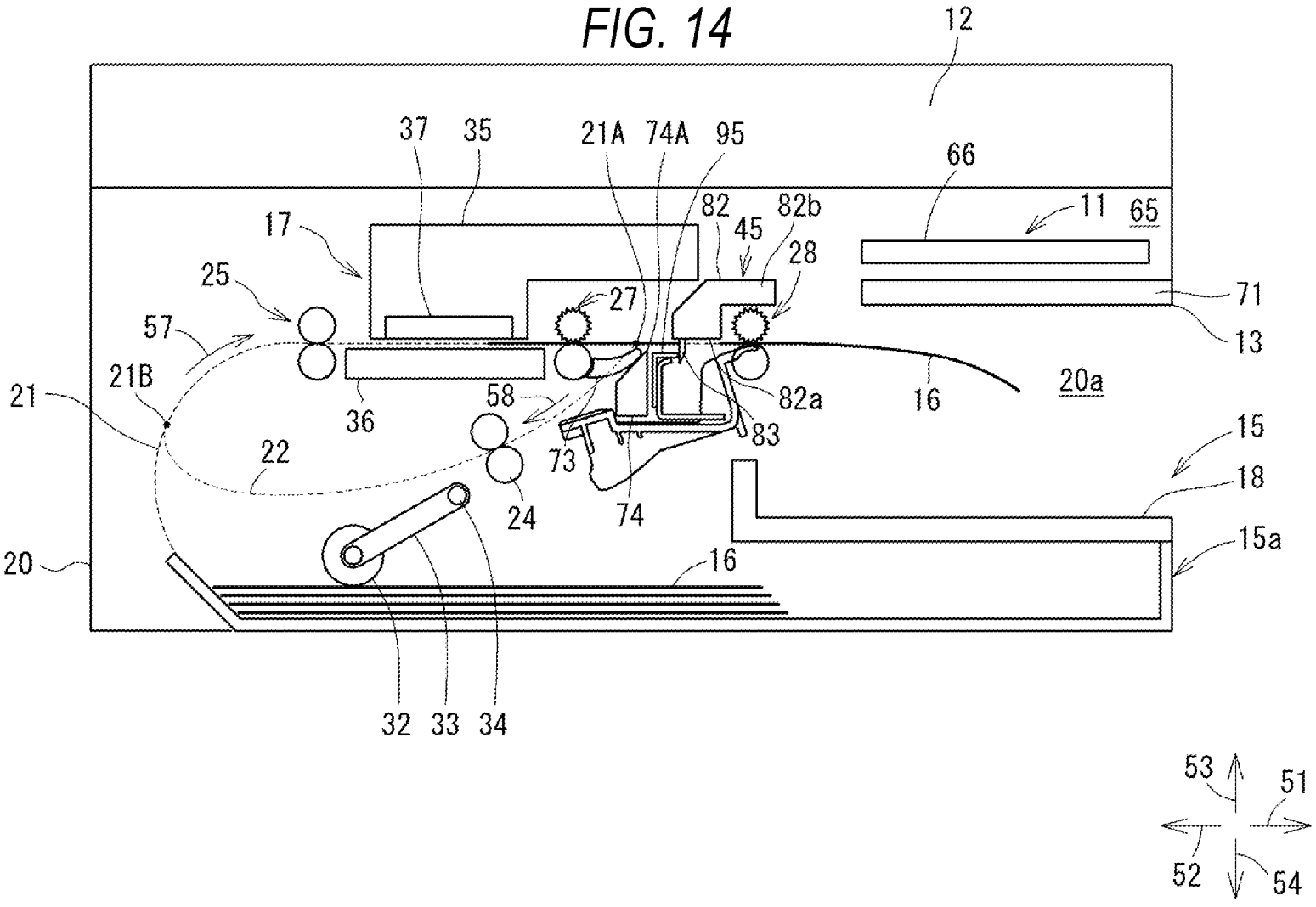

FIG. 14 schematically shows the image recording operation.

In the following description, a direction in which an opening 13 of a printer unit 11 faces is referred to as a front direction 51, and a direction opposite to the front direction is referred to as a rear direction 52. The front and rear are collectively referred to as front and rear directions 51 and 52 (an example of the conveying direction). Upper and lower directions orthogonal to the front and rear directions 51 and 52 are referred to as upper and lower directions 53 and 54. Directions orthogonal to the front and rear directions 51 and 52 and the upper and lower directions 53 and 54 are referred to as left and right directions 55 and 56. In the upper and lower directions 53 and 54, the upward direction is referred to as the upper direction 53, and the downward direction is referred to as the lower direction 54. When seeing the image recording apparatus 10 in the rear direction 52, the leftward direction of the left and right directions 55 and 56 is referred to as the left direction 55, and the rightward direction is referred to as the right direction 56.

Figure 1:
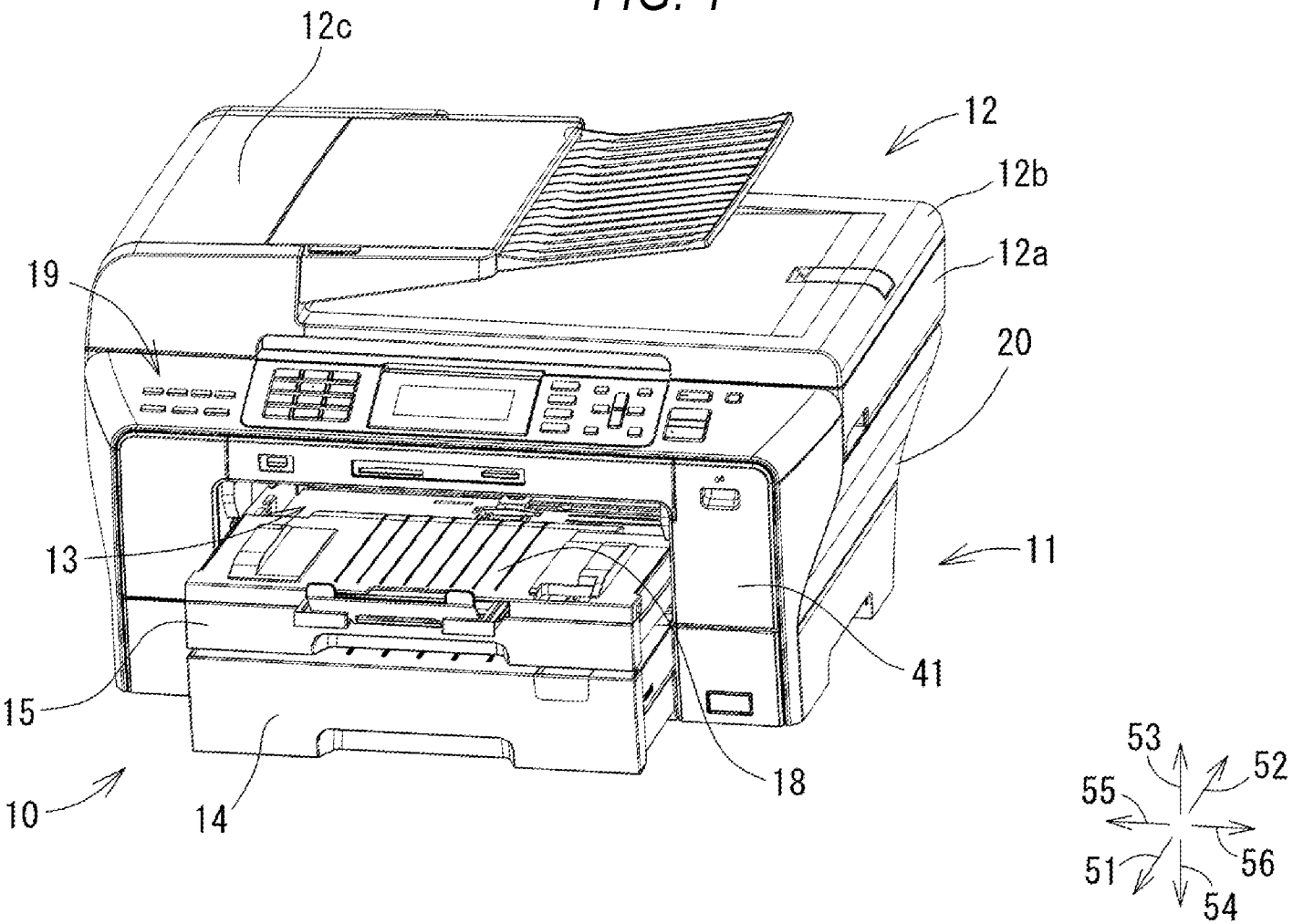

As shown in FIG. 1, the image recording apparatus 10 is a complex machine integrally provided with a printer unit 11 provided at a lower part and a scanner unit 12 provided at an upper part. The image recording apparatus 10 has a print function, a scan function, a copy function, and a facsimile function. Note that, the image recording apparatus 10 is not necessarily required to have the scanner unit 12, and may be implemented as a single-function printer without a scan function and a copy function.

The image recording apparatus 10 is mainly used in a state of being connected to an external information device (not shown) such as a computer. The printer unit 11 is configured to record an image on a sheet 16, based on print data received from the external information device or image data of a document read by the scanner unit 12. An operation panel 19 is provided on a front upper part of the image recording apparatus 10. The operation panel 19 includes a display for displaying various types of information and an input key configured to receive an input of information. The image recording apparatus 10 is configured to operate based on instruction information input from the operation panel 19 or instruction information transmitted from the external information device via a printer driver, a scanner driver, or the like.

The scanner unit 12 is located above the printer unit 11. The scanner unit 12 is a so-called flat head scanner. The scanner unit 12 includes a scanner body 12*a* provided above the printer unit 11 and a document cover 12*b* provided above the scanner body 12*a*. A platen glass (not shown) on which a document is to be placed is provided on an upper surface of the scanner body 12*a*. An image sensor (not shown) capable of optically reading an image of a document on the platen glass is provided in the scanner body 12*a*. The document cover 12*b* is provided with an ADF 12*c* that is an Automatic Conveying Mechanism configured to pick up and convey a plurality of documents, from which images are to be read, one by one.

[Printer Unit 11]

Hereinafter, a configuration of the printer unit 1 will be described with reference to FIGS. 1 to 3. Note that, in FIG. 2, a sheet feeding cassette 14 is not shown for simplification of description.

Figure 2:
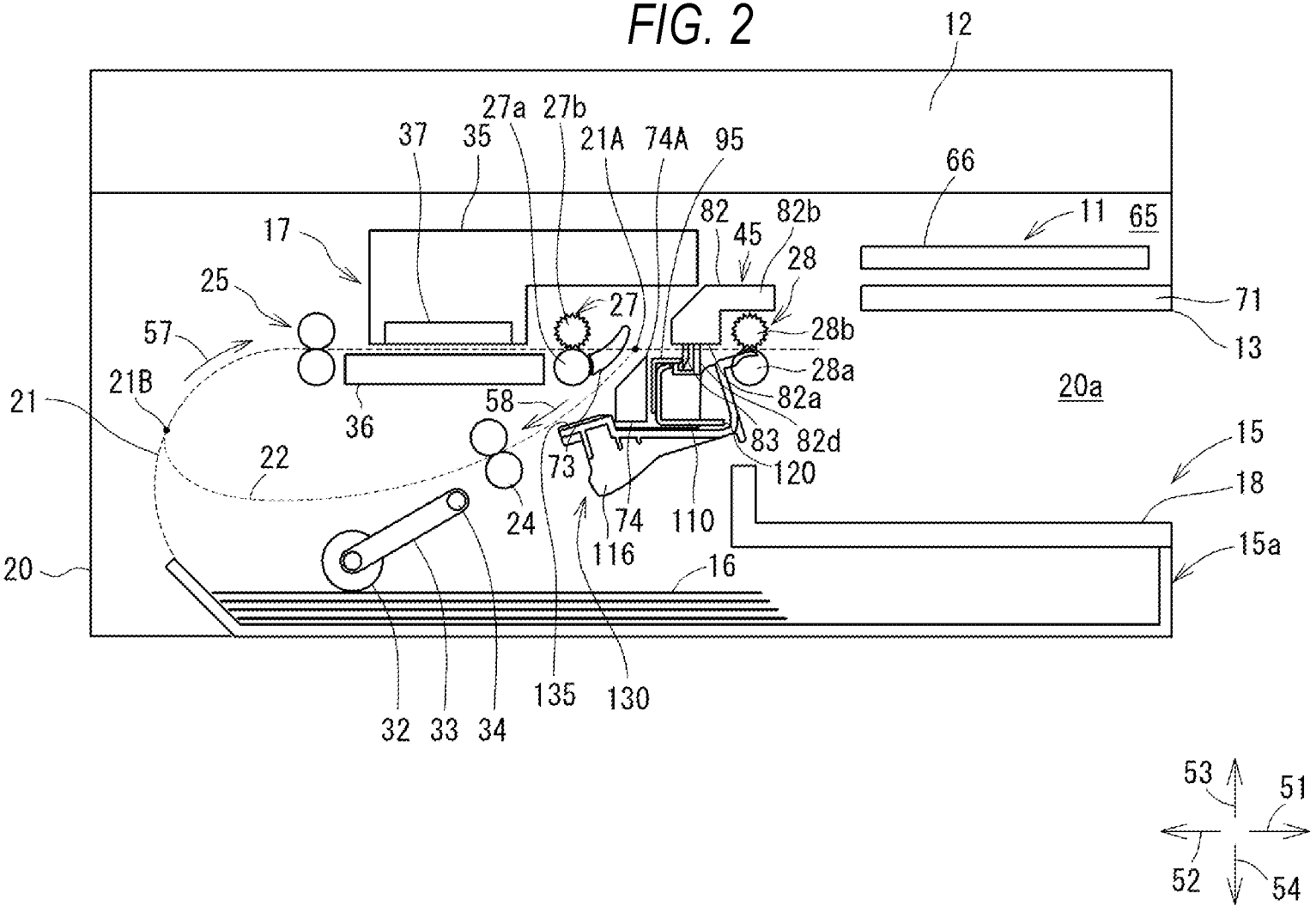

As shown in FIGS. 1 and 2, the printer unit 11 has a housing 20. In the housing 20, a sheet feeding cassette 14, a sheet feeding cassette 15, a recording unit 17, a cutting unit 45, and other functional components are arranged. An opening 13 is located below the operation panel 19 on the front surface of the housing 20. The opening 13 is located at a substantial center of the front surface of the housing 20 in the left and right directions 55 and 56. The opening 13 is formed in a rectangular shape elongated in the left and right directions 55 and 56. The opening 13 extends from an upper part to a lower end on the front surface of the housing 20.

The housing 20 has an internal space 20*a* extending rearward from the opening 13. The internal space 20*a* is configured to communicate with a first conveyance path 21, which will be described later. An upper end of the internal space 20*a* is formed by an upper wall part 71 extending in the rear direction 52 from the upper end of the opening 13. The internal space 20*a* extends to the lower end of the housing 20. The upper wall part 71 partitions a substrate accommodation space 65 arranged at the rear of the operation panel 19 and the internal space 20*a* each other. In the substrate accommodation space 65, a control substrate 66 (an example of the control unit) on which an electronic circuit electrically connected to the operation panel 19, a recording head 37, a sensor, a rotary encoder, a drive circuit of a motor and the like is mounted is accommodated.

On the front surface of the housing 20, an opening/closing cover 41 is attached to the right of the opening 13. When the opening/closing cover 41 is opened, a cartridge mounting space is opened, and an ink cartridge 40 configured to store ink can be mounted or demounted to or from the housing 20. As shown in FIGS. 2 and 3, the ink cartridge 40 is located in front of the recording unit 17 in the housing 20. In the present embodiment, four ink cartridges 40 each configured to hold four types of inks of different colors can be mounted to the housing 20. Each ink cartridge 40 is configured to supply ink to the recording head 37 of the recording unit 17 through a tube 44.

As shown in FIG. 1, the sheet feeding cassette 14 and the sheet feeding cassette 15 are mounted to the housing 20 while being inserted in the opening 13. The sheet feeding cassette 14 and the sheet feeding cassette 15 can be removably inserted into the housing 20 along the front and rear directions 51 and 52. The sheet feeding cassette 14 is located below the sheet feeding cassette 15 in a state of being mounted to the housing 20. As shown in FIG. 2, the sheet feeding cassette 15 is configured to accommodate a plurality of regular sheets 16 in a state of being stacked. The regular sheet 16 is an A3 size, an A4 size, a B5 size or the like according to Japanese Industrial Standards. At the top of the sheet feeding cassette 15, a sheet discharging tray 18 is located. The sheet discharging tray 18 is configured to support the sheet 16 discharged from the first conveyance path 21. Note that, although the two types of the sheet feeding cassette 14 and the sheet feeding cassette 15 are provided in the present embodiment, the sheet feeding cassette 14 may be omitted.

The sheet feeding cassette 15 is configured to hold a plurality of sheets 16. The sheet feeding cassette 15 is formed in a container shape whose part on a rear side (left side in FIG. 2) of the image recording apparatus 10 is opened. The sheets 16 are held in a stacked state within an internal space of the sheet feeding cassette 15. The sheet discharging tray 18 of the sheet feeding cassette 15 is formed on the front surface side (right side in FIG. 2) of the image recording apparatus 10. FIG. 2 shows a state in which the sheet feeding cassette 15 is inserted in the housing 20.

As shown in FIG. 2, in the housing 20, a conveying unit 43 configured to convey the sheet 16 from the sheet feeding cassette 15 to the sheet discharging tray 18 along the first conveyance path 21 is arranged. The first conveyance path 21 is a so-called U-turn path that makes a U-turn to reach the recording head 37 while being curved in the upper direction 53 and the front direction 51 from the sheet feeding cassette 15, and linearly extends in the front direction 51 from the recording head 37 toward the sheet discharging tray 18, inside the housing 20. A downstream end of the first conveyance path 21 is configured to communicate with the internal space 20*a*. A direction from the sheet feeding cassette 15 toward the sheet discharging tray 18 is referred to as a first conveying direction 57. In the first conveyance path 21, from the upstream side of the first conveying direction 57, a pair of PF rollers 25, a recording head 37 and a platen 36, a pair of discharge rollers 27 (an example of the first roller), a cutting unit 45, and a pair of reversing rollers 28 (an example of the second roller) are located in this order.

In the housing 20, a second conveyance path 22 is connected at a first position 21A (an example of the connection position) where is further downstream than the pair of discharge rollers 27 on the first conveyance path 21 in the first conveying direction 21 and is further upstream than the cutting unit 45, and at a second position 21B where is further upstream than the pair of PF rollers 25 in the first conveying direction 57. The second conveyance path 22 is a conveyance path for conveying a sheet conveyed on the first conveyance path 21, subjected to image recording on a first side by the recording head 37 and conveyed further downstream than the pair of discharge rollers 27 in the first conveying direction 57, toward an upstream of the recording head 37 on the first conveyance path 21 in the first conveying direction 57, so as to perform image recording on a second side. The second conveyance path 22 extends in the lower direction 54 and in the rear direction 52 from the first position 21A, passes above a first guide member 130, a second guide member 74, and the sheet feeding cassette 15, which will be described later, and reaches the second position 21B located at a curved portion of the first conveyance path 21. A direction from the pair of reversing rollers 28 toward the first position 21A and the second position 21B is referred to as a second conveying direction 58.

The sheet feeding roller 32 is located above the sheet feeding cassette 15. The sheet feeding roller 32 is provided at a tip end portion of an arm 33 so as to be rotatable about the left and right directions 55 and 56 as an axis line direction. A base end portion of the arm 33 is rotatable about a shaft 34. As the arm 33 rotates, the sheet feeding roller 32 moves in a contact/separation direction with respect to the sheet feeding cassette 15. The arm 33 is rotated toward the sheet feeding cassette 15 by a weight of the sheet feeding roller 32. Thereby, the sheet feeding roller 32 comes into contact with the uppermost sheet 16 of the plurality of sheets 16 placed in a stacked state in the sheet feeding cassette 15. When the sheet feeding roller 32 rotates in this state, the uppermost sheet 16 is delivered from the sheet feeding cassette 15 to the first conveyance path 21.

The pair of PF rollers 25 is located in the vicinity of a downstream end of the curved portion of the first conveyance path 21 with respect to the first conveying direction 57. The pair of PF rollers 25 is rotatable about the left and right directions 55 and 56 as an axis line direction. The pair of PF rollers 25 is configured to rotate as drive a motor (not shown) is transmitted thereto. The sheet 16 delivered by the sheet feeding roller 32 is sandwiched by the pair of PF rollers 25 and is conveyed in the first conveying direction 57 toward below the recording head 37. Although not shown in the drawing, an amount of rotation of the pair of PF rollers 25 is detected by, for example, a rotary encoder. A detection signal of the rotary encoder is output to the control substrate 66.

The pair of discharge rollers 27 is located, in the first conveyance path 21, further downstream than the pair of PF rollers 25 and the recording head 37 in the first conveying direction 57. The pair of discharge rollers 27 is configured to rotate in synchronization with the pair of PF rollers 25, as drive of the motor (not shown) is transmitted thereto. The sheet 16 that is conveyed by the pair of PF rollers 25 is sandwiched by the pair of discharge rollers 27 and conveyed in the first conveying direction 57. The pair of discharge rollers 27 has a discharge roller 27*a* configured to be driven by the control unit 66 and a driven roller 27*b* configured to be driven by rotation of the discharge roller 27*a*.

The pair of reversing rollers 28 is located, in the first conveyance path 21, further downstream than the pair of discharge rollers 27 and the first position 21A in the first conveying direction 57. The pair of reversing rollers 28 is configured to rotate in a forward or reverse direction as drive of the motor (not shown) is transmitted thereto. The pair of reversing rollers 28 rotating in the forward direction is configured to convey, to the sheet discharging tray 18, the sheet 16 that is sandwiched by the pair of discharge rollers 27 and conveyed in the first conveying direction 57. The pair of reversing rollers 28 rotating in the reverse rotation is configured to convey the sheet 16 in a direction from the pair of reversing rollers 28 toward the first position 21A, i.e., in the second conveying direction 58. The pair of reversing rollers 28 has a reversing roller 28*a* configured to be driven by the control unit 66 and a driven roller 28*b* configured to be driven by rotation of the reversing roller 28*a*.

In the second conveyance path 22, a pair of intermediate rollers 24 is located. The pair of intermediate rollers 24 is rotatable about the left and right directions 55 and 56 as an axial direction. The pair of intermediate rollers 24 is configured to rotate as drive of a motor (not shown) is transmitted thereto. The sheet 16 conveyed in the second conveying direction 58 on the second conveyance path 22 from the first position 21A is sandwiched by the pair of intermediate rollers 24 and conveyed toward the second position 21B.

As shown in FIG. 2, in the first conveyance path 21, a sensor 38 is located further upstream than the pair of PF rollers 25 in the first conveying direction 57. The sensor 38 is configured to detect a tip end and a rear end of the sheet 16 that is conveyed along the curved portion of the first conveyance path 21. The sensor 38 is configured to detect, with an optical sensor, a rotary body configured to rotate due to contact with the sheet 16, for example. A detection signal output by the sensor 38 is output to the control substrate 66.

As shown in FIG. 2, the recording unit 17 is located between the pair of PF rollers 25 and the pair of discharge rollers 27 in the first conveyance path 21. The recording unit 17 is configured to record an image on the sheet 16. The recording unit 17 includes a carriage 35 located above the first conveyance path 21, a platen 36 located below the first conveyance path 21, and a recording head 37 mounted to the carriage 35.

Figure 3:
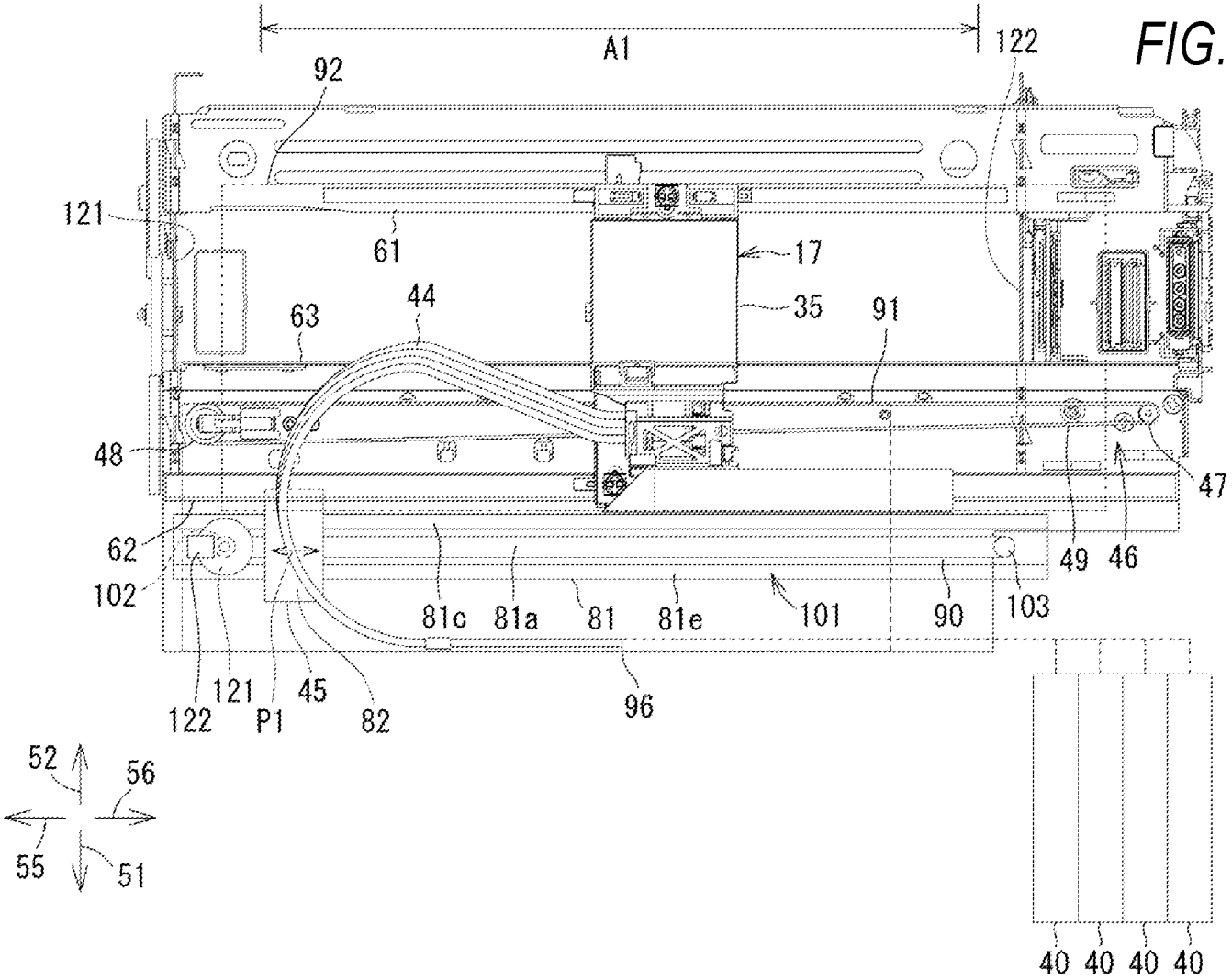

As shown in FIG. 3, the recording head 37 is of a so-called inkjet type supplied with ink of each color of cyan (C), magenta (M), yellow (Y) and black (Bk) from the ink cartridges 40 through the tubes 44, and configured to eject each ink as minute ink droplets. While the carriage 35 is reciprocally moved in the left and right directions 55 and 56, ink droplets are ejected from the recording head 37, whereby image recording is performed on the sheet 16 being conveyed on the platen 36.

Figure 5:
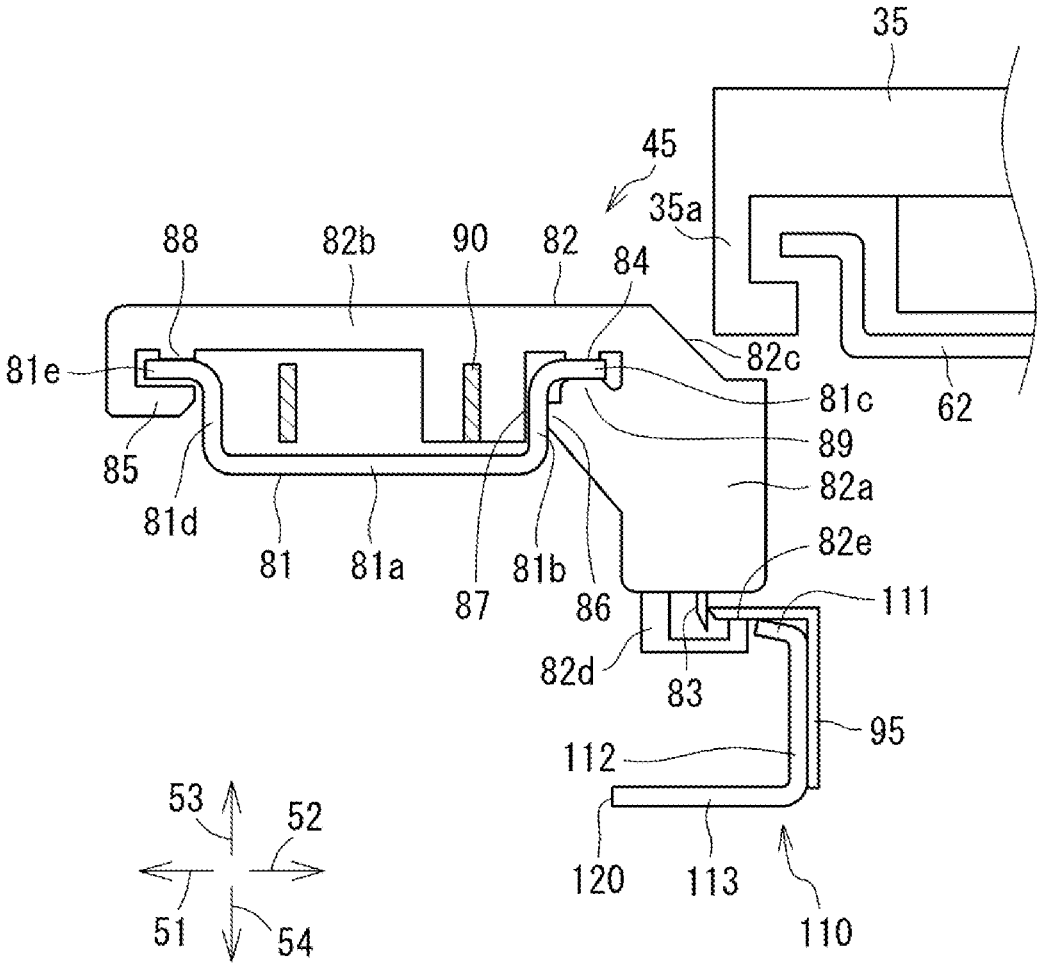
FIG. 5 is a side view of a cutting unit 45 of the image recording apparatus 10.

As shown in FIG. 3, the carriage 35 is supported by guide frames 61 and 62 spaced apart in the front and rear directions 51 and 52 and each extending in the left and right directions 55 and 56. The carriage 35 is placed so as to be reciprocally movable in the left and right directions 55 and 56 while spanning the guide frames 61 and 62. The guide frame 61 arranged posteriorly is of a flat plate shape whose length in the left and right directions 55 and 56 is longer than a reciprocating range of the carriage 35, and an upper surface of the guide frame 61 is configured to slidably support a rear end portion of the carriage 35. As shown in FIG. 5, a front end portion 35*a* of the carriage 35 has a portion overlapping the guide frame 62 in the upper and lower directions 53 and 54 to prevent the carriage 35 from falling upward from the guide frame 62.

As shown in FIG. 3, the guide frame 62 located anteriorly is of a flat plate shape whose length in the left and right directions 55 and 56 is substantially the same as that of the guide frame 61, and an edge portion 63 configured to support the front end portion of the carriage 35 is bent upward approximately at a right angle. The carriage 35 is slidably supported on an upper surface of the guide frame 62, and is configured to sandwich the edge portion 63 by a roller (not shown) or the like. Therefore, the carriage 35 is slidably supported on the guide frames 61 and 62, and can reciprocally move in the left and right directions 55 and 56 with respect to the edge portion 63 of the guide frame 62 as a reference.

A belt drive mechanism 46 is arranged on the upper surface of the guide frame 62. The belt drive mechanism 46 has an endless annular belt 49 having teeth on an inner side and stretched between a first pulley 47 and a second pulley 48 respectively provided in the vicinity of both ends of the first conveyance path 21 in the left and right directions 55 and 56. The first pulley 47 and the second pulley 48 are arrange at both ends of a region where the carriage 35 reciprocally moves. A drive force is input from a CR motor (not shown) as a drive source to a shaft of the first pulley 47, so that the first pulley 47 is rotated. The belt 49 is configured to circumferentially move by rotation of the first pulley 47, and at that time, the second pulley 48 is configured to be driven by the rotation. Note that, the belt 49 may be an ended belt whose both end portions are fixed to the carriage 35, other than the endless annular belt.

The carriage 35 is fixed to the belt 49. Although a connection part of the carriage 35 and the belt 49 is not shown in detail in each drawing, the belt 49 is slightly tensioned upward in a state of being connected to the carriage 35. Thereby, a tensile force that elastically returns downward is generated in the belt 49, and the carriage 35 is elastically urged toward the guide frames 61 and 62 by the tensile force. As described above, when the belt 49 circumferentially moves, the carriage 35 reciprocally moves over the guide frames 61 and 62 with respect to the edge portion 63 as a reference. The recording head 37 is mounted to such a carriage 35, so that the recording head 37 can reciprocally move in the left and right directions 55 and 56 of the first conveyance path 21 as a main scanning direction.

The tube 44 is a tube made of synthetic resin, and has flexibility to bend according to the reciprocating movement of the carriage 35. The tubes 44 are provided in four, corresponding to the four ink cartridges 40. One end of each tube 44 is connected to a case (not shown) for accommodating the ink cartridge 40. The other end of each tube 44 is connected to the recording head 37 in the carriage 35. Each tube 44 extends in the left direction 55 from the carriage 35, is curved to U-turn rearward and extends leftward between the carriage 35 and the ink cartridge 40 in the front and rear directions 51 and 52, and is fixed to the housing 20 at a fixed position 96. From the fixed position 96 to the case of the ink cartridge 40, the tubes 44 are appropriately arranged. Each tube 44 follows the carriage 35 while changing the U-turning curved shape, along with the movement of the carriage 35 in the left and right directions 55 and 56.

As shown in FIG. 2, a flap 73 is located, in the first conveyance path 21, further downstream than the pair of discharge rollers 27 in the first conveying direction 57 and just upstream of the first position 21A in the first conveying direction 57. The flap 73 extends in the front direction 51 and in the upper direction 53 from an axis of the lower roller of the pair of discharge rollers 27. An extending end of the flap 73 is in the vicinity of the first position 21A. A length of the flap 73 in the left and right directions 55 and 56 may span an entire image recording area A1, or a plurality of flaps 73 shorter than the image recording area A1 may be aligned at intervals in the left and right directions 55 and 56. The flap 73 is configured to be rotatable about the axis of the lower roller of the pair of discharge rollers 27. The flap 73 is urged by a spring (not shown), and is maintained in a posture (position shown in FIG. 2) extending in the front direction 51 and in the upper direction 53 from the axis of the lower roller of the pair of discharge rollers 27. When the sheet 16 conveyed from the pair of discharge rollers 27 in the first conveying direction 57 abuts against an upper surface of the flap 73, the flap 73 rotates clockwise in FIG. 2 while resisting the spring urging. Thereby, the sheet 16 conveyed in the first conveying direction 57 reaches the pair of reversing rollers 28 beyond the flap 73. On the other hand, when the sheet 16 conveyed from the pair of reversing rollers 28 in the second conveying direction 58 abuts against the flap 73, the sheet 16 is guided to a lower surface of the flap 73 and enters the second conveyance path 22 from the first position 21A.

Figure 4:
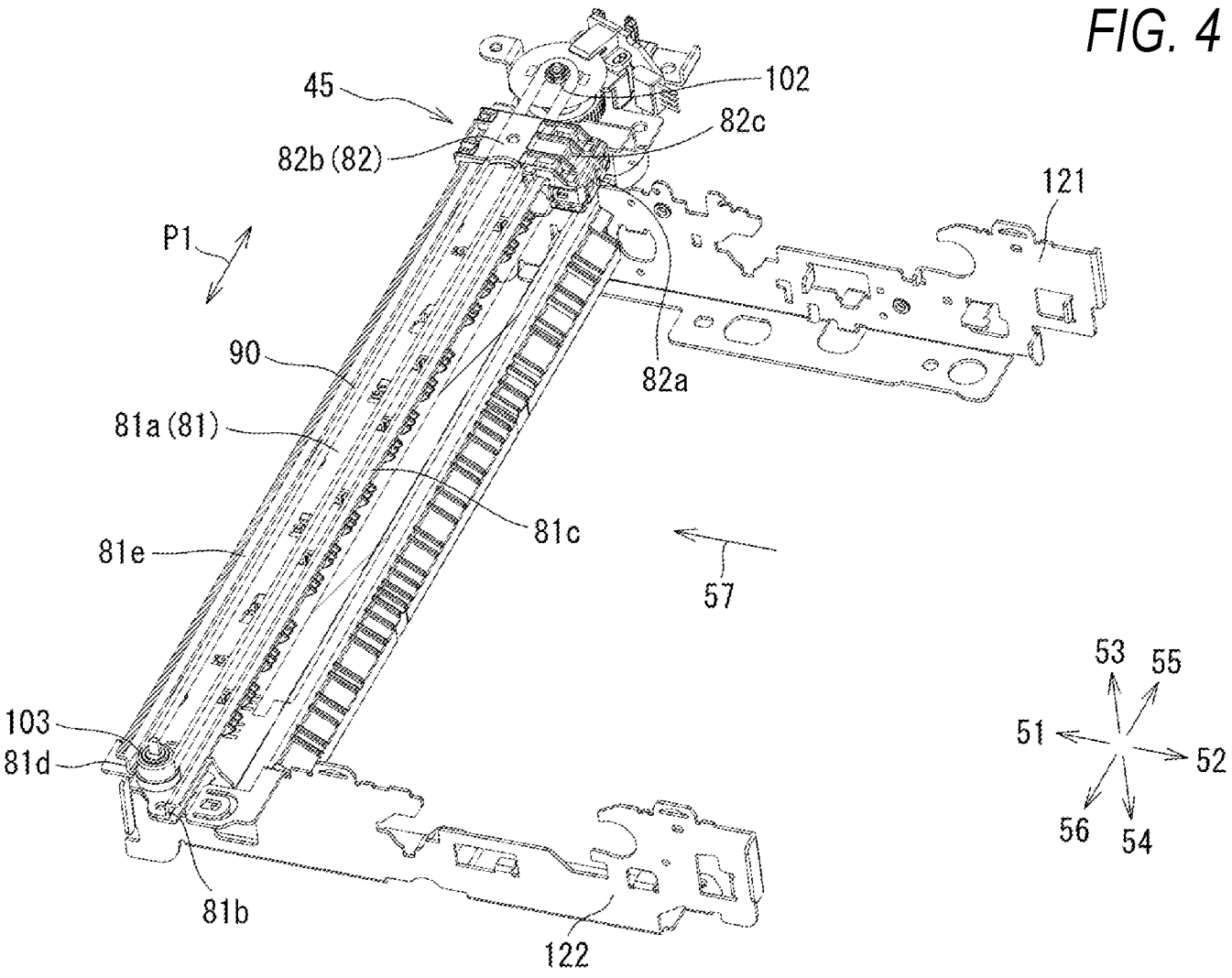

As shown in FIG. 4, the cutting unit 45 is connected to a pair of side frame 121 and 122 extending in the left and right directions 55 and 56. The cutting unit 45 is configured to move along an intersection direction P1 (left and right directions 55 and 56) intersecting the first conveying direction 57 and to cut the sheet 16 conveyed by the pair of discharge rollers 27 and the pair of reversing rollers 28.

As shown in FIGS. 4 and 5, the cutting unit 45 includes a guide rail 81 extending along the left and right directions 55 and 56, a cutter carriage (an example of the carriage) 82 configured to be guided by the guide rail 81 and to move in the intersection direction P1, a moving blade 83 mounted to the cutter carriage 82 and a fixed blade (an example of the cutter) 95. Note that, in FIG. 5, in order to easily understand the structure of the cutting unit 45, an endless belt 90, which will be described later, is shown in a cross section. In addition, in FIG. 2, the detailed configuration of the cutting unit 45 is omitted and is shown briefly.

The guide rail 81 has a flat shape extending along the left and right directions 55 and 56. Both end portions of the guide rail 81 in the left and right directions 55 and 56 are fixed to the side frames 121 and 122 on which rotating shafts of the pair of discharge rollers 27 are supported. A length of the guide rail 81 in the left and right directions 55 and 56 is longer than a length of the first conveyance path 21 in the left and right directions 55 and 56. The left and right ends of the guide rail 81 extend outward beyond the image recording area A1.

The guide rail 81 has a substrate 81*a* extending in the left and right directions 55 and 56, a first standing plate 81*b* extending upward from a rear end of the substrate 81*a*, a first extension plate 81*c* extending in the rear direction 52 from an upper end of the first standing plate 81*b*, a second standing plate 81*d* extending upward from a front end of the substrate 81*a*, and a second extension plate 81*e* extending in the front direction 51 from an upper end of the second standing plate 81*d*. The substrate 81*a*, the first standing plate 81*b*, the first extension plate 81*c*, the second standing plate 81*d*, and the second extension plate 81*e* are formed by bending one rectangular steel sheet.

As shown in FIGS. 2 and 3, the cutter carriage 82 is located, in the first conveyance path 21, between the first position 21A and the pair of reversing rollers 28, i.e., further downstream than the first position 21A and further upstream than the pair of reversing rollers 28 in the first conveying direction 57. As shown in FIGS. 3 and 4, the cutter carriage 82 is located at the left of the image recording area A1 at the time of stopping. The image recording area A1 is a maximum width where ink is ejected from the recording head 37 configured to reciprocally move together with the carriage 35 and image recording is performed on the sheet 16. When a maximum size recordable by the printer unit 11 is an A4 size, the image recording area A1 is slightly wider than a width of the A4 size.

The cutter carriage 82 is configured to cut the sheet 16 by moving in the right direction 56 from a stop position (position of the cutter carriage 82 indicated by a broken line in FIG. 3) at the left of the image recording area A1. By the cutting unit 45, one A4-size sheet 16 is cut into two A5-size sheets 16, for example.

The cutter carriage 82 has a cutter holding part 82*a* configured to hold the moving blade 83, a connection part 82*b* connected to the guide rail 81, and an arm part following a lower side of the fixed blade 95. The cutter holding part 82*a* is located at the rear of the guide rail 81. Note that, the cutter holding part 82*a* may be located in front of the guide rail 81. The cutter holding part 82*a* extends downward beyond the guide rail 81. The moving blade 83 is supported by the cutter holding part 82*a* in a state of protruding downward from a lower end of the cutter holding part 82*a*. The moving blade 83 has a disk shape, and is supported by the cutter holding part 82*a* so as to be rotatable about the front and rear directions 51 and 52 as an axis line direction.

The connection part 82*b* extends in the front direction 51 from the cutter holding part 82*a* and is connected to the guide rail 81. The connection part 82*b* has a first contact portion 84 in contact with an upper surface of the first extension plate 81*c*, a second contact portion 85 contactable on a lower surface of the second extension plate 81*e*, a third contact portion 86 in contact with a surface of the first standing plate 81*b* facing in the rear direction 52, a fourth contact portion 87 in contact with a surface of the first standing plate 81*b* facing in the front direction 51, a fifth contact portion 88 in contact with an upper surface of the second extension plate 81*e*, and a sixth contact portion 89 contactable on a lower surface of the first extension plate 81*c*.

Figure 6:
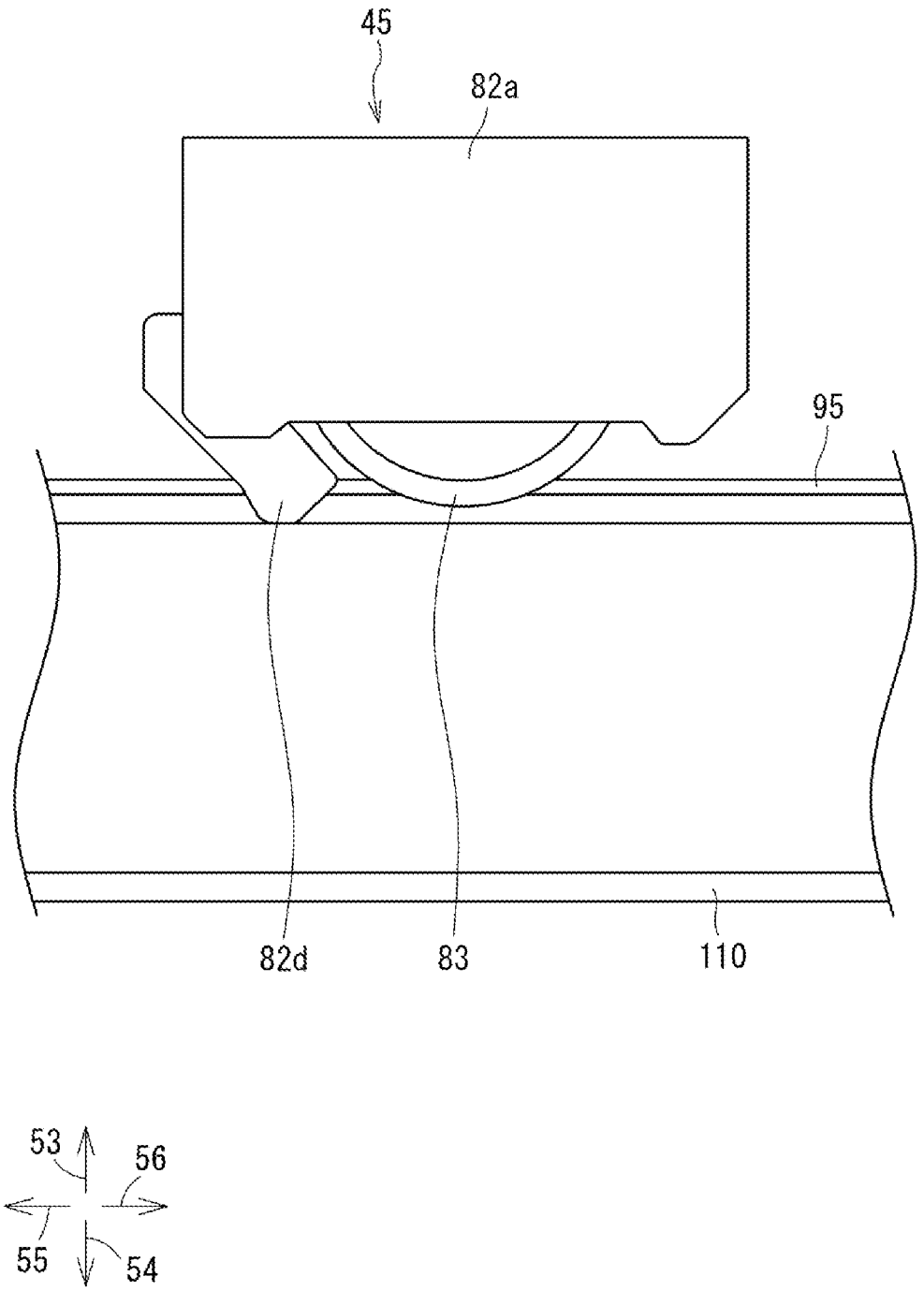
FIG. 6 is a front view of a cutter 83 and a fixed blade 95.

As shown in FIGS. 5 and 6, the arm part 82*d* is located on a left lower side of the cutter holding part 82*a*. The arm part 82*d* extends downward from the cutter holding part 82*a*, is bent rearward and extends, and is bent upward, so that a tip end portion 82*e* follows a lower surface of the fixed blade 95. The arm part 82*d* is arranged so that the tip end portion 82*e* abuts against the lower surface of the fixed blade 95 when the cutter holding part 82*a* vibrates in the upper and lower directions 53 and 54, or the like. Although not shown in the drawing, the cutter holding part 82*a* has a spring for urging the moving blade 83 in the rear direction 52. The moving blade 83 is urged in the rear direction 52 by the spring to abut against a blade edge 85*a* of the fixed blade 95. Thereby, the sheet 16 can be securely cut by the moving blade 83 and the fixed blade 95. The arm part 82*d* is configured to prevent the moving blade 83 from sitting on the fixed blade 95 even when the cutter holding part 82*a* vibrates in the upper and lower directions 53 and 54 or the position of the fixed blade 95 deviates in the upper and lower directions 53 and 54.

The guide rail 81 is configured to abut against the first contact portion 84 and the fifth contact portion 88, thereby supporting the cutter carriage 82 downward. Thereby, the cutter carriage 82 is positioned in the upper and lower directions 53 and 54. The guide rail 81 is configured to abut against the third contact portion 86 and the fourth contact portion 87, respectively, thereby positioning the cutter carriage 82 with respect to the front and rear directions 51 and 52. When the cutter carriage 82 moves upward with respect to the guide rail 81, at least one of the second contact portion 85 or the sixth contact portion 89 abuts against the guide rail 81. Thereby, the cutter carriage 82 is prevented from separating upward from the guide rail 81.

The cutter holding part 82*a* has an inclined surface 82*c* on an outer upper surface. The inclined surface 82*c* faces in the rear direction 53 and in the upper direction 52. The inclined surface 82*c* overlaps an end portion 35*a* on a front side of the carriage 35 in the upper and lower directions 53 and 54 and in the front and rear directions 51 and 52, when seen from the left and right directions 55 and 56. Thereby, the image recording apparatus 10 is downsized in the upper and lower directions 53 and 54 and in the front and rear directions 51 and 52. The cutter holding part 82*a* has the inclined surface 82*c*, so that while a front side portion of the cutter holding part 82*a*, i.e., a portion close to the connection part 82*b* is made to have a thickness to give strength in the upper and lower directions 53 and 54 and in the front and rear directions 51 and 52, a gap between the cutter carriage 82 and the carriage 35 can be reduced.

The cutter carriage 82 is configured to be driven by a drive mechanism 101. The drive mechanism 101 includes a drive pulley 102 and a driven pulley 103 arranged on the upper surface of the substrate 81*a*, and an endless belt 90 spanning the drive pulley 102 and the driven pulley 103. The drive pulley 102 and the driven pulley 103 are arranged at both end portions on the upper surface of the substrate 81*a* in the left and right directions 55 and 56. The driving pulley 102 and the driven pulley 103 are configured to rotate around axis lines along the upper and lower directions 53 and 54. A drive force of a motor (not shown) is transmitted to the drive pulley 102. The endless belt 90 is connected to the cutter carriage 82 in front of the fourth contact portion 87 of the connection part 82*b* of the cutter carriage 82. When the drive pulley 102 rotates, the endless belt 90 circumferentially moves, and the driven pulley 103 is accordingly driven. By the circumferential movement of the endless belt 90, the cutter carriage 82 reciprocally moves along the guide rail 81 in the left and right directions 55 and 56.

The fixed blade 95 is located below the cutter holding part 82*a* of the cutter carriage 82. The fixed blade 95 is connected to the pair of side frames 121 and 122 and extends in the left and right directions 55 and 56 intersecting the first conveying direction 57 over the image recording area A1. The blade edge 95*a* of the fixed blade 95 is in contact with the moving blade 83 from the rear. The sheet 16 is sandwiched and cut between the moving blade 83 and the fixed blade 95.

As shown in FIG. 5, a protection member 110 is arranged below the cutter carriage 82 and is configured to cover a lower side of the moving blade 83. The protection member 110 is formed by, for example, bending a steel plate, and is configured to restrict movement of the fixed blade 95 in the front and rear directions 51 and 52 and in the lower direction 54 by being connected to the fixed blade 95. The protection member 110 extends along the left and right directions 55 and 56, and both ends thereof are connected to the pair of side frames 121 and 122. The protection member 110 includes an upper piece 111 in contact with a lower surface on a tip end side of the fixed blade 95, a middle piece 112 extending from a rear end of the upper piece 111 and following a front surface on a base end side of the fixed blade 95, and a lower piece 113 extending from a lower end of the middle piece 112 in the front and rear directions 51 and 52 to cover the moving blade 83. The lower piece 113 is formed with a plurality of cutouts spaced in the left and right directions 55 and 56. The lower piece 113 is configured to cover the lower side of the fixed blade 95.

Figure 8:
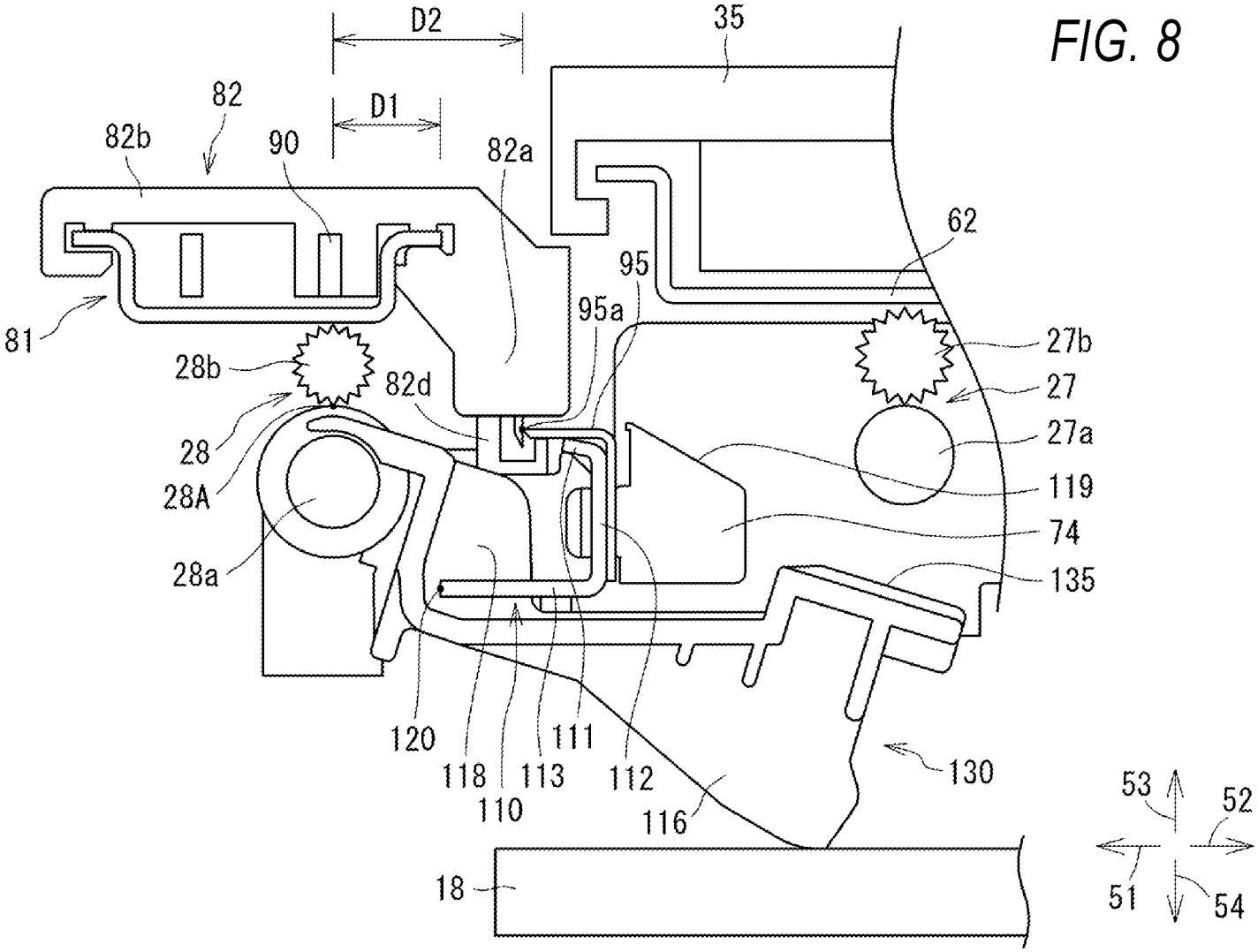
FIG. 8 shows the first guide member 130 in a first posture.

As shown in FIG. 8, the first guide member 130 is connected to the reversing roller 28*a*. As shown in FIG. 2, the first guide member 130 is located below the recording unit 17 and below the cutter carriage 82. The first guide member 130 has a body part 116, a connection part 117, a first guide surface 135, and ribs 118.

Figure 7:
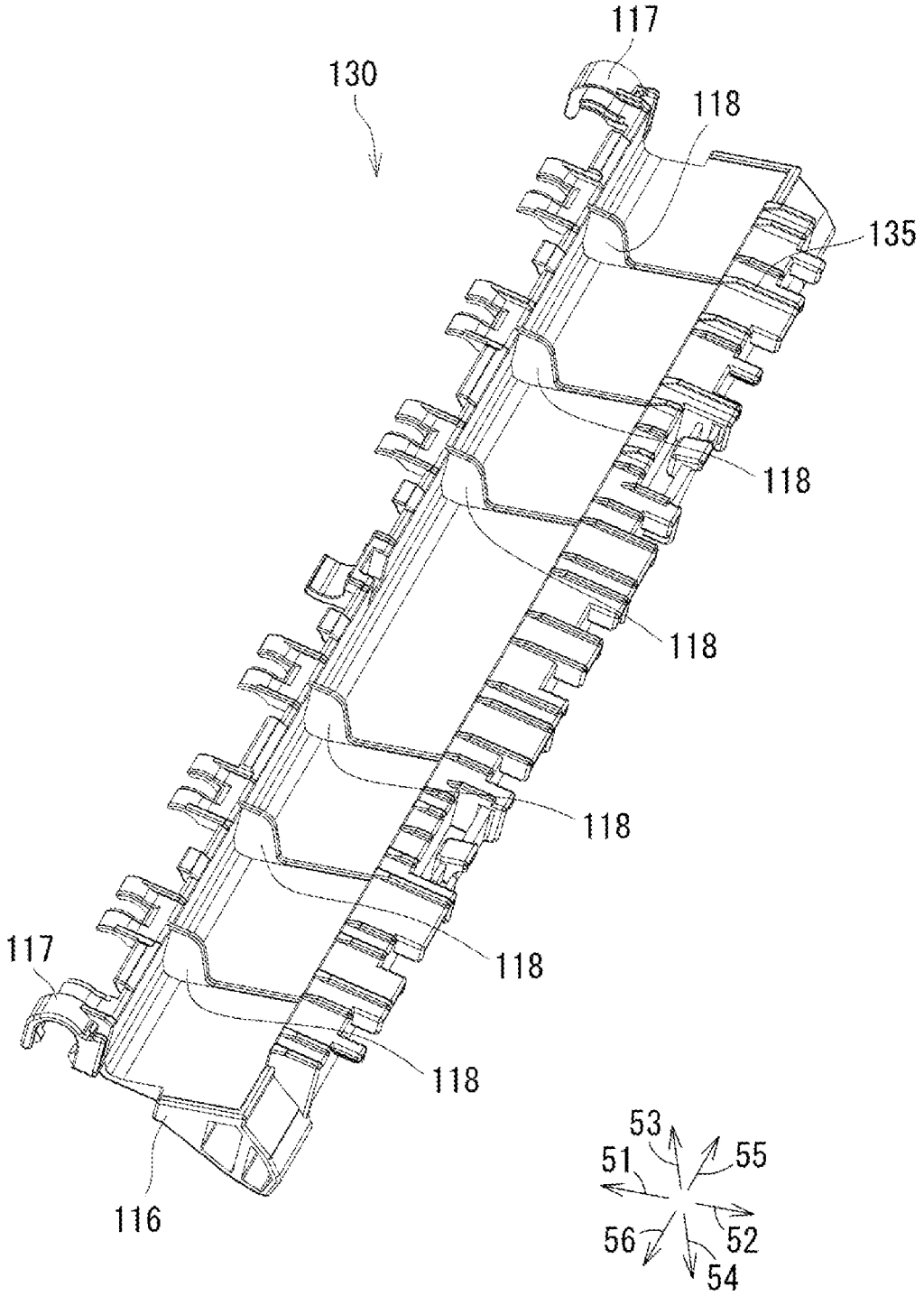
FIG. 7 is an outward perspective view of a first guide member 130 of the image recording apparatus 10.

As shown in FIG. 7, the body part 116 has a shape whose thickness increases from the front toward the rear and extending in the left and right directions 55 and 56. The body part 116 is formed to be flat between adjacent ribs 118.

The connection part 117 has a substantially U-shaped section. The connection part 117 is rotatably supported by the shaft of the reversing roller 28*a*.

The first guide surface 135 is a surface extending along the front and rear directions 51 and 52 on an upper surface of the rear of the body part 116. The first guide surface 135 is configured to form a part of the lower side of the second conveyance path 22 and to support the sheet 16 that is conveyed in the second conveying direction 58.

The rib 118 has a predetermined thickness in the left and right directions and extends in the front and rear and upper and lower directions. The rib 118 is configured to reinforce the body part 116. The rib 118 is disposed at the front of the upper surface of the body part 116. The plurality of ribs 118 are provided on the upper surface of the body part 116 while being spaced in the left and right directions 55 and 56. Each of the ribs 118 is arranged at a position where it fits into the cutout of the protection member 110 when the body part 116 rotates about the reversing roller 28*a* and is in a state of following the lower sides of the second guide member 74 and the protection member 110.

As shown in FIGS. 2 and 8, the second guide member 74 is located between the first guide surface 135 of the first guide member 130 and the pair of reversing rollers 28. The second guide member 74 is located further downstream than the first guide surface 135 of the first guide member 130 in the first conveying direction 57 and further upstream than the fixed blade 95 of the cutting unit 45 in the first conveying direction 57. The second guide member 74 is fixed to the protection member 110 by a screw or the like. The second guide member 74 extends in the left and right directions 55 and 56 over the image recording area A1. An upper surface of the second guide member 74 is a second guide surface 119. The second guide surface 119 forms a part of the lower side of the second conveyance path 22 in the vicinity of the first position 21A. The second guide surface 119 is an inclined surface that rises upward toward the downstream in the first conveying direction 57. In other words, the second guide surface 119 extends in the lower direction 54 and in the rear direction 52 along the second conveying direction 58. An upstream end of the second guide surface 119 with respect to the second conveying direction 58 (downstream end with respect to the first conveying direction 57) is an upper end 74A. The upper end 74A is located above the blade edge 95*a* of the fixed blade 95.

[Layout of First Guide Member 130]

Figure 9:
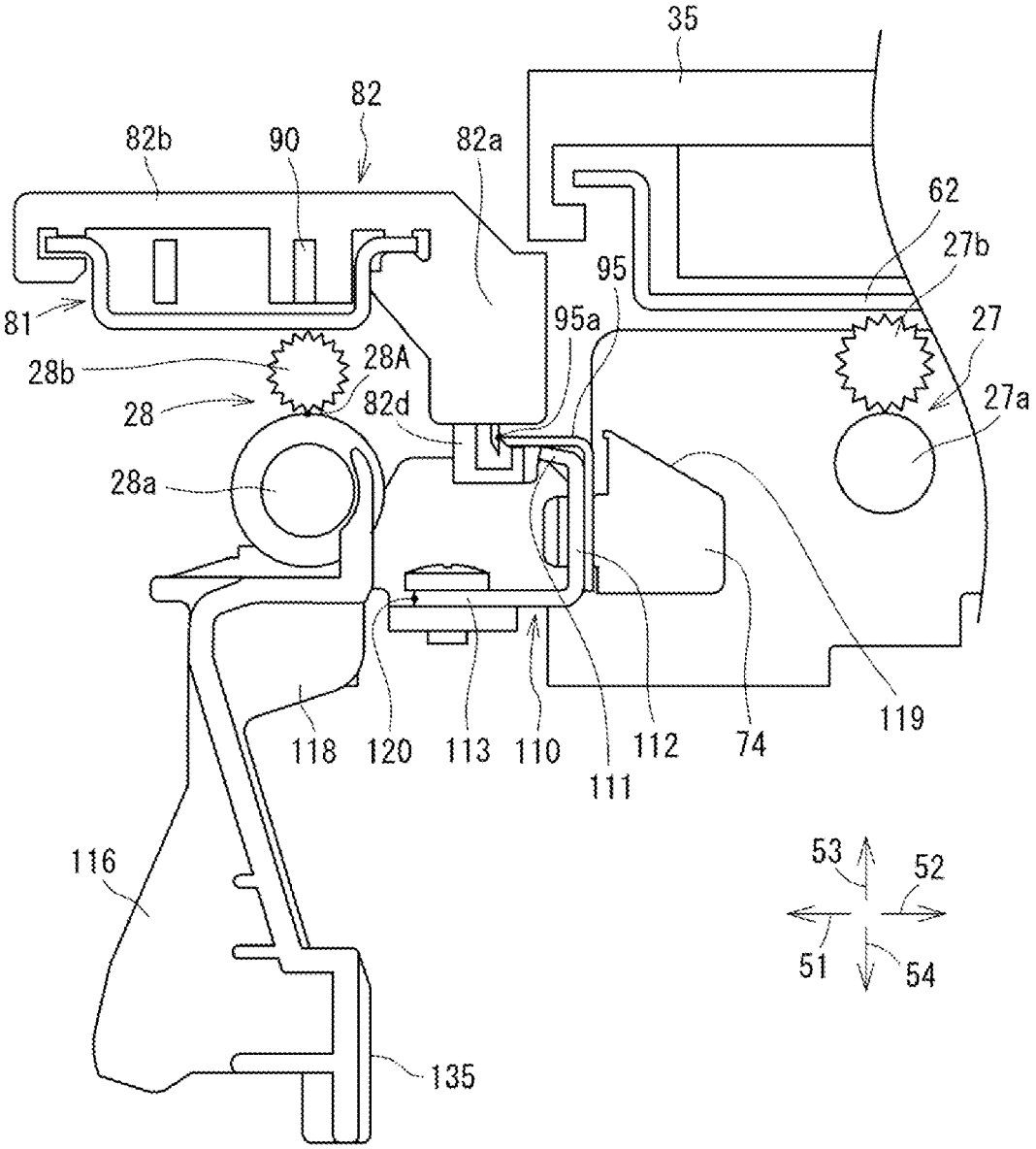
FIG. 9 shows the first guide member 130 in a second posture.

As shown in FIGS. 8 and 9, the first guide member 130 is rotatably supported by the reversing roller 28*a*, and changes in posture between a first posture for forming the second conveyance path 22 and a second posture for opening the second conveyance path 22. The first guide member 130 is supported by the sheet discharging tray 18 when it is in the first posture, so that the body part 116 is located below the protection member 110 and the second guide member 74. The first guide member 130 is located below the protection member 110 and the second guide member 74 in the first posture, and the first guide surface 135 follows the lower side of the second conveyance path 22. At this time, when the first guide member 130 is in the first posture, the ribs 118 are located in the cutouts of the protection member 110. In addition, as shown in FIG. 8, in the first posture, a first distance D1, which is a distance along the first conveying direction 57 from a downstream end 120 of the protection member 110 with respect to the first conveying direction 57 to a nip position 28A of the pair of reversing rollers 28, is shorter than a second distance D2, which is a distance along the first conveying direction 57 from the blade edge 95*a* of the fixed blade 95 to the nip position 28A of the pair of reversing rollers 28 (D1<D2).

Figure 10:
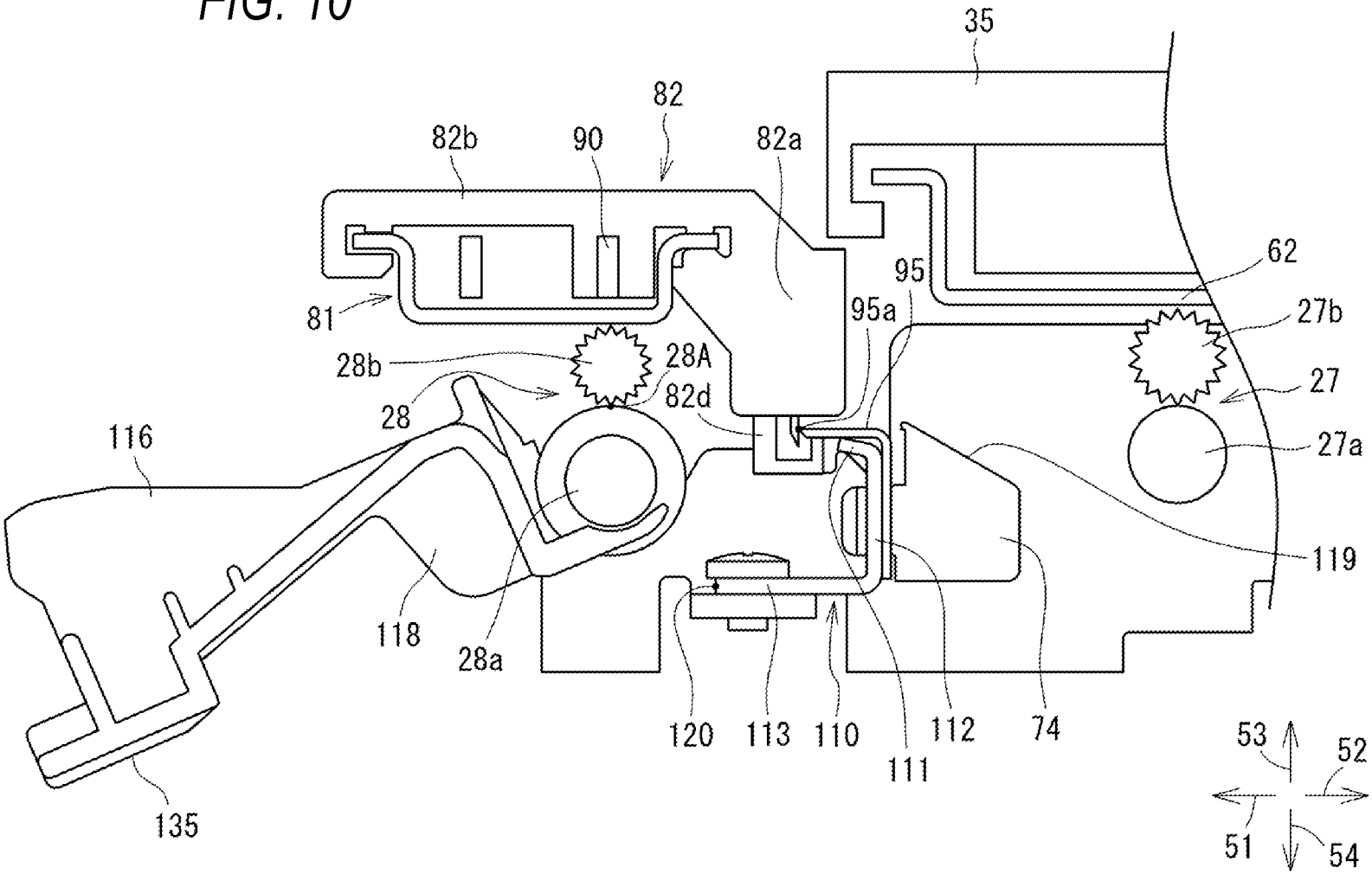
FIG. 10 shows a state in which the first guide member 130 is further rotated clockwise from the state of FIG. 9.

When the sheet discharging tray 18 is drawn forward, the first guide member 130 rotates clockwise around the reversing roller 28*a* by its own weight. At this time, as shown in FIG. 9, the first guide member 130 is in a state of being hung from the reversing roller 28*a*, and the lower sides of the second guide member 74 and the protection member 110 are opened. As shown in FIG. 10, the first guide member 130 is further rotated clockwise by the user. Thereby, the image recording apparatus 10 is in a state in which the user can resolve a jam occurred in the image recording apparatus 10.

[Image Recording]

Hereinafter, an image recording operation by the printer unit 11 will be described. In the below, an operation in which images are recorded on both sides of the A4-size sheet 16 and the sheet is cut to the A5-size sheets will be described as an example. The image recording operation is implemented when the control circuit mounted to the control substrate 66 controls drives of each motor and the recording head 37.

As shown in FIG. 11, when the sheet feeding roller 32 rotates, one uppermost A4-size sheet 16 is delivered from the sheet feeding cassette 15 to the first conveyance path 21. The sheet 16 delivered from the sheet feeding cassette 15 to the first conveyance path 21 is conveyed in the first conveying direction 57 toward below the recording head 37 by the pair of PF rollers 25. The sheet 16 conveyed below the recording head 37 is supported by the platen 36 from below. While the conveying of the sheet 16 is stopped, the carriage 35 moves in the left and right directions 55 and 56 and ink is ejected from the recording head 37 toward the sheet 16. Thereby, an image of one pass is recorded on the first side of the sheet 16. While the conveying and stop of the sheet 16 are repeated, image recording of a predetermined pass is performed, so that the image recording on the first side of the sheet 16 is ended. Here, image recording of two A5 recording sheets is performed on the A4 sheet 16. At the time of image recording, the sheet 16 having passed through the platen 36 is conveyed in the first conveying direction 57 toward the sheet discharging tray 18 by the pair of discharge rollers 27 and the pair of reversing rollers 28.

The control substrate 66 monitors a position of the rear end (downstream end with respect to the first conveying direction 57) of the sheet 16 conveyed in the first conveying direction 57, based on the detection signal of the sensor and an amount of rotation of the pair of PF rollers 25 (detection signal of the rotary encoder). The control substrate 66 rotates the pair of reversing rollers 28 in the forward direction when conveying the sheet 16 in the first conveying direction 57.

As shown in FIG. 12, the control substrate 66 switches the rotation of the pair of reversing rollers 28 from forward rotation to reverse rotation, on condition that the rear end of the sheet 16 is located between the flap 73 and the second guide member 74, in other words, near the first position 21A.

As shown in FIG. 13, when the pair of reversing rollers 28 is rotated in the reverse direction, the sheet 16 is conveyed in the second conveying direction 58, and the sheet 16 is guided to the flap 73 to enter the second conveyance path 22. In the second conveyance path 22, the sheet 16 is conveyed in the second conveying direction 58 by the pair of intermediate rollers 24 and the pair of reversing rollers 28 to reach the second position 21B.

The sheet 16 entering the first conveyance path 21 from the second position 21B is conveyed in the first conveying direction 57 toward below the recording head 37 by the pair of PF rollers 25, so that image recording is performed on the second side (side opposite to the first side) of the sheet 16, similarly to the image recording on the first side. Also on the second side of the sheet 16, similarly to the first side, image recording of two A5 recording sheets is performed on the A4 sheet 16. At the time of image recording on the second side, the sheet 16 having passed through the platen 36 is conveyed in the first conveying direction 57 toward the sheet discharging tray 18 by the pair of discharge rollers 27 and the pair of reversing rollers 28. Note that, the control substrate 66 switches the rotation of the pair of reversing rollers 28 from reverse rotation to forward rotation, on condition that the rear end of the sheet 16 conveyed in the second conveying direction 58 has passed through the pair of reversing rollers 28.

When the center of the sheet 16 in the first conveying direction 57 is conveyed below the cutting unit 45, the control substrate 66 rotates the drive pulley 102 so that the cutter carriage 82 moves in the rear direction 56 from the stop position (refer to FIG. 3) along the guide rail 81. Thereby, the A4 sheet 16 is sandwiched by the moving blade 83 and the fixed blade 95, is cut along the left and right directions 55 and 56, and becomes two A5 sheets. The two A5 sheets are discharged from the first conveyance path 21 to the sheet discharging tray 18 by the pair of reversing rollers 28 rotating in the forward direction.

When a sheet jam occurs in the second conveyance path 22 and an abnormal conveying of the sheet 16 is detected, the control unit 66 stops the rotation of each roller and displays an error message, which indicates that the sheet jam has occurred, on the display of the operation panel 19. When the user pulls out the sheet feeding cassette 15 from the housing 20, the posture of the first guide member 130 in the first posture changes to the second posture. By further rotating the first guide member 130 in the second posture clockwise in FIG. 9, the user can access the second conveyance path 22 and remove the sheet 16 jammed in the second conveyance path 22. In the second conveyance path 22 opened by the first guide member 130 rotated to the second posture or further clockwise, the protection member 110 covers the lower side of the fixed blade 95, so that the user does not inadvertently contact the fixed blade 95. Further, even when the second conveyance path 22 is opened at the time of replacing the moving blade 83, the protection member 110 covers the lower side of the fixed blade 95, so that the user does not inadvertently contact the fixed blade 95.

Operational Effects of Embodiment

According to the image recording apparatus 10, since the lower side of the second conveyance path 22 is opened by changing the posture of the first guide member 130 from the first posture to the second posture, the user can put the user's hand into the image recording apparatus 10 to resolve a jam occurred in the image recording apparatus 10.

In addition, since the protection member 110 covers the lower side of the moving blade 83, when the user accesses the internal space 20*a* of the image recording apparatus 10 from below the moving blade 83 to resolve a jam occurred in the image recording apparatus 10, it is difficult for a user's finger to contact the moving blade 83. Further, since the lower part of the moving blade 83 is covered by the protection member 110, grit and dust generated as a result of cutting the sheet is less likely to fall downward.

Further, the first distance D1 in the first conveying direction 57 from the downstream end 120 of the protection member 110 to the pair of reversing rollers 28 is shorter than the second distance D2 in the first conveying direction 57 from the moving blade 83 to the pair of reversing rollers 28. That is, the protection member 110 covers the moving blade 83 from the upstream toward the downstream of the moving blade 83 with respect to the first conveying direction 57. For this reason, it is further difficult for the user who puts the user's hand into the internal space 20*a* of the image recording apparatus 10 to resolve a jam occurred in the image recording apparatus 10 to contact the moving blade 83.

Further, since the second support member is located further upstream than the cutter in the conveying direction 57, even when the user puts the user's hand into the internal space 20*a* from the upstream of the conveying direction so as to resolve the jam, it is difficult for the user to contact the moving blade 83 due to the second support member.

Further, since the upper end 74A of the second guide member 74 is located above the moving blade 83, the first conveyance path 21 forms a complicated space. For this reason, it is further difficult for the user who puts the user's hand into the internal space 20*a* so as to resolve the jam to contact the moving blade 83.

Further, since the moving blade 83, the fixed blade 95, and the second guide member 74 are connected to the pair of side frames 121 and 122, it is possible to attach each of them with high precision, and to securely cut the sheet 16.

While the invention has been described in conjunction with various example structures outlined above and illustrated in the figures, various alternatives, modifications, variations, improvements, and/or substantial equivalents, whether known or that may be presently unforeseen, may become apparent to those having at least ordinary skill in the art. Accordingly, the example embodiments of the disclosure, as set forth above, are intended to be illustrative of the invention, and not limiting the invention. Various changes may be made without departing from the spirit and scope of the disclosure. Therefore, the disclosure is intended to embrace all known or later developed alternatives, modifications, variations, improvements, and/or substantial equivalents. Some specific examples of potential alternatives, modifications, or variations in the described invention are provided below.

MODIFIED EMBODIMENTS

In the above embodiment, the case where the first guide member 130 rotates about the reversing roller 28*a* as an axis has been described. However, the present disclosure is not limited thereto. The first guide member 130 may be able to change in posture between the first posture for forming the second conveyance path 22 and the second posture for opening the second conveyance path 22. For example, the first guide member 130 may be removed from the reversing roller 28*a*.

In addition, the cutting unit 45 is configured so that the sheet 16 is cut by the cutter 83 and the fixed blade 95. However, the structure of the cutting unit 45 is not particularly limited as long as it can cut the sheet 16 along the left and right directions 55 and 56. For example, in the cutting part 45, instead of the fixed blade 95, two disk-shaped rotating blades like the cutter 83 may be mounted to the cutter carriage 82. In this case, even when the cutter carriage 82 is moved to the image recording area A1 at the time of resolving a jam of a sheet or replacing the rotating blade, the protection member covers the lower side of the rotating blade at that position, so that it is difficult for the user to contact the rotating blade.

In the above embodiment, the cutting unit 45 cuts the regular rectangular sheet 16 but may also cut a medium drawn out from a roll body wound in a roll shape into the regular rectangular sheet 16.

Further, although the first conveyance path 21 and the second conveyance path 22 are double-sided conveyance paths for recording images on both sides of the sheet 16, the present disclosure is not limited thereto. The conveyance path may be a path where one so-called U-turn path making a U-turn while being curved upward from the sheet feeding cassette 15 is formed and an image is recorded on only one side of the sheet 16.

In addition, a part of the cutting unit 45 overlaps, in the vertical directions 53 and 54, a part of the movement space where the carriage 35 passes when moving in the left and right directions 55 and 56, but, as shown in FIG. 3, may not overlap the movement space in the upper and lower directions 53 and 54.

Further, although the tube 44 overlaps the carriage 35 in the front and rear directions 51 and 52, but may not overlap the carriage 35 in the front and rear directions 51 and 52.

Further, the tube 44 is located in front of the carriage 35 but may be located at the rear of the carriage 35.

Further, the pair of second discharge rollers 28 is located below the cutting unit 45 when seen from the left and right directions 55 and 56, but may not be located below the cutting unit 45 when seen from the left and right directions 55 and 56.

Further, the pair of second discharge rollers 28 is located in front of the cutter holding part 82*a* of the cutting unit 45 when seen from the left and right directions 55 and 56, but may be located at the rear of the cutter holding part 82*a* when seen from the left and right directions 55 and 56.

What is claimed is:

1. An image recording apparatus comprising:

a recording unit configured to perform image recording on a sheet that is conveyed in a conveying direction on a first conveyance path;

a first roller located, in the first conveyance path, further downstream than the recording unit in the conveying direction;

a second roller located, in the first conveyance path, further downstream than the first roller in the conveying direction;

a first guide member having a first guide surface that forms a second conveyance path extending from a connection position of the first conveyance path between the first roller and the second roller; and a cutting unit located between the connection position of the first conveyance path and the second roller, and configured to cut a sheet, wherein the cutting unit has a cutter, and the first guide member is configured to change in posture between a first posture for forming the second conveyance path and a second posture for opening the second conveyance path.

2. The image recording apparatus according to claim 1, further comprising:

a protection member configured to cover a lower side of the cutter.

3. The image recording apparatus according to claim 2, wherein a first distance from a downstream end of the protection member with respect to the conveying direction to the second roller in the conveying direction is shorter than a second distance from the cutter to the second roller in the conveying direction.

4. The image recording apparatus according to claim 1, further comprising a second guide member having a second guide surface located between the first guide surface of the first guide member and the second roller to form the second conveyance path, wherein the cutter extends in a direction intersecting the conveying direction and is located further downstream than the second guide member in the conveying direction, and the first guide member is configured to change in posture between the first posture and the second posture by rotation.

5. The image recording apparatus according to claim 4, wherein an upper end of the second guide member is located above the cutter.

6. The image recording apparatus according to claim 4, wherein the cutting unit further has:

a carriage configured to move in an intersection direction intersecting the conveying direction; and a moving blade mounted to the carriage, a guide rail, which is configured to guide the carriage, is connected to a pair of side frames, the cutter is connected to the pair of side frames, and the second guide member is connected to the pair of side frames.

* * * * *